US007540033B2

(12) United States Patent
Kim et al.

(10) Patent No.: US 7,540,033 B2
(45) Date of Patent: Jun. 2, 2009

(54) DEVICE FOR OPENING-CLOSING SUN VISOR OF HELMET

(75) Inventors: Young-Il Kim, Gunpo-si (KR); Chang-Seob Lee, Yongin-si (KR); Dal Busco Giacomo, Montebelluna (IT)

(73) Assignee: HJC Co. Ltd. (KR)

( * ) Notice: Subject to any disclaimer, the term of this patent is extended or adjusted under 35 U.S.C. 154(b) by 372 days.

(21) Appl. No.: 11/335,855

(22) Filed: Jan. 19, 2006

(65) Prior Publication Data

US 2007/0136933 A1 Jun. 21, 2007

(30) Foreign Application Priority Data

Dec. 15, 2005 (KR) ..... 10-2005-0124124

(51) Int. Cl.
*F41H 1/04* (2006.01)

(52) U.S. Cl. ..... 2/6.7

(58) Field of Classification Search ..... 2/6.7, 2/8.3, 15, 424

See application file for complete search history.

(56) References Cited

U.S. PATENT DOCUMENTS 3,110,034 A * 11/1963 Aileo ..... 2/6.5
3,237,202 A * 3/1966 Aileo ..... 2/6.5
3,400,407 A * 9/1968 Aileo ..... 2/6.5
3,721,994 A * 3/1973 DeSimone et al. ..... 2/410
3,775,774 A * 12/1973 Herman ..... 2/8.3
4,170,042 A * 10/1979 Aileo ..... 2/424
4,922,550 A * 5/1990 Verona et al. ..... 2/6.2
6,249,918 B1 * 6/2001 Lacroix ..... 2/424
6,606,751 B1 * 8/2003 Kalhok et al. ..... 2/424
6,640,346 B2 * 11/2003 Dufresne ..... 2/424
6,644,308 B2 * 11/2003 Kalhok et al. ..... 128/201.24
2007/0016997 A1 * 1/2007 Reddington ..... 2/5
2007/0136933 A1 * 6/2007 Kim et al. ..... 2/424

* cited by examiner

*Primary Examiner*—Shaun R Hurley
*Assistant Examiner*—Andrew W Sutton
(74) *Attorney, Agent, or Firm*—R. Neil Sudol; Henry D. Coleman; William J. Sapone

(57) ABSTRACT

A device for opening-closing sun visor of a helmet is disclosed. The device comprises a helmet body 10 provided in front with an opening portion 11 for the face and having a pair of hinge shafts 12 protruded on both the left and right sides, a sun visor 20 having a visor portion 21 placed on the side of the opening portion 11 of the helmet body 10, extending portions 22 extended to the left and right sides of the visor portion 21, and hinge slots 23 formed at the ends of the extending portions 22; and an opening-closing mechanism 30 having a slider 31 connected to the top center of the visor portion 21 of the sun visor 20, a guide rail 32 which is attached to the ceiling of the helmet body 10, and a guide holder 35 which is attached lengthwise to the top center of the helmet body.

1 Claim, 5 Drawing Sheets

【Fig. 1】
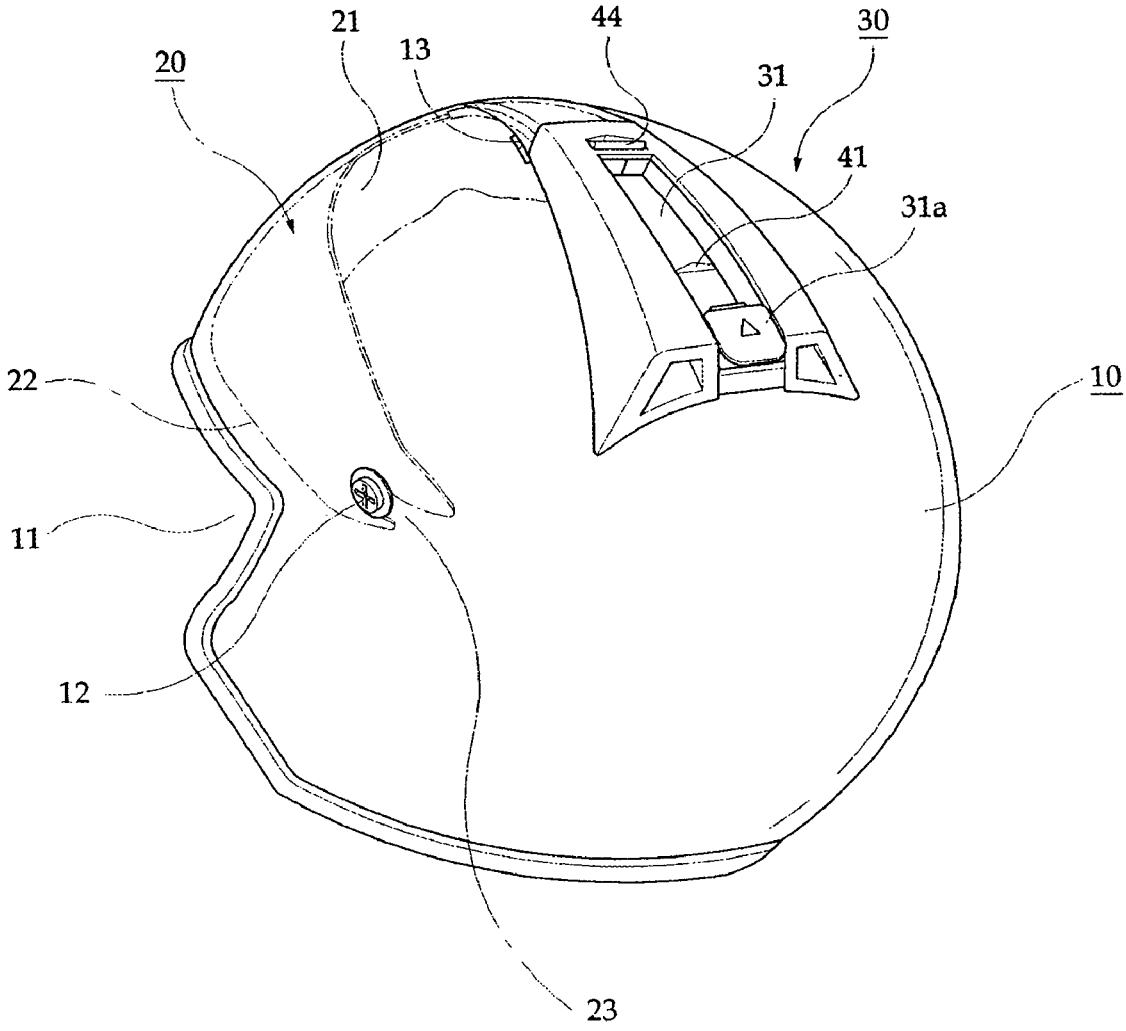

【Fig. 2】
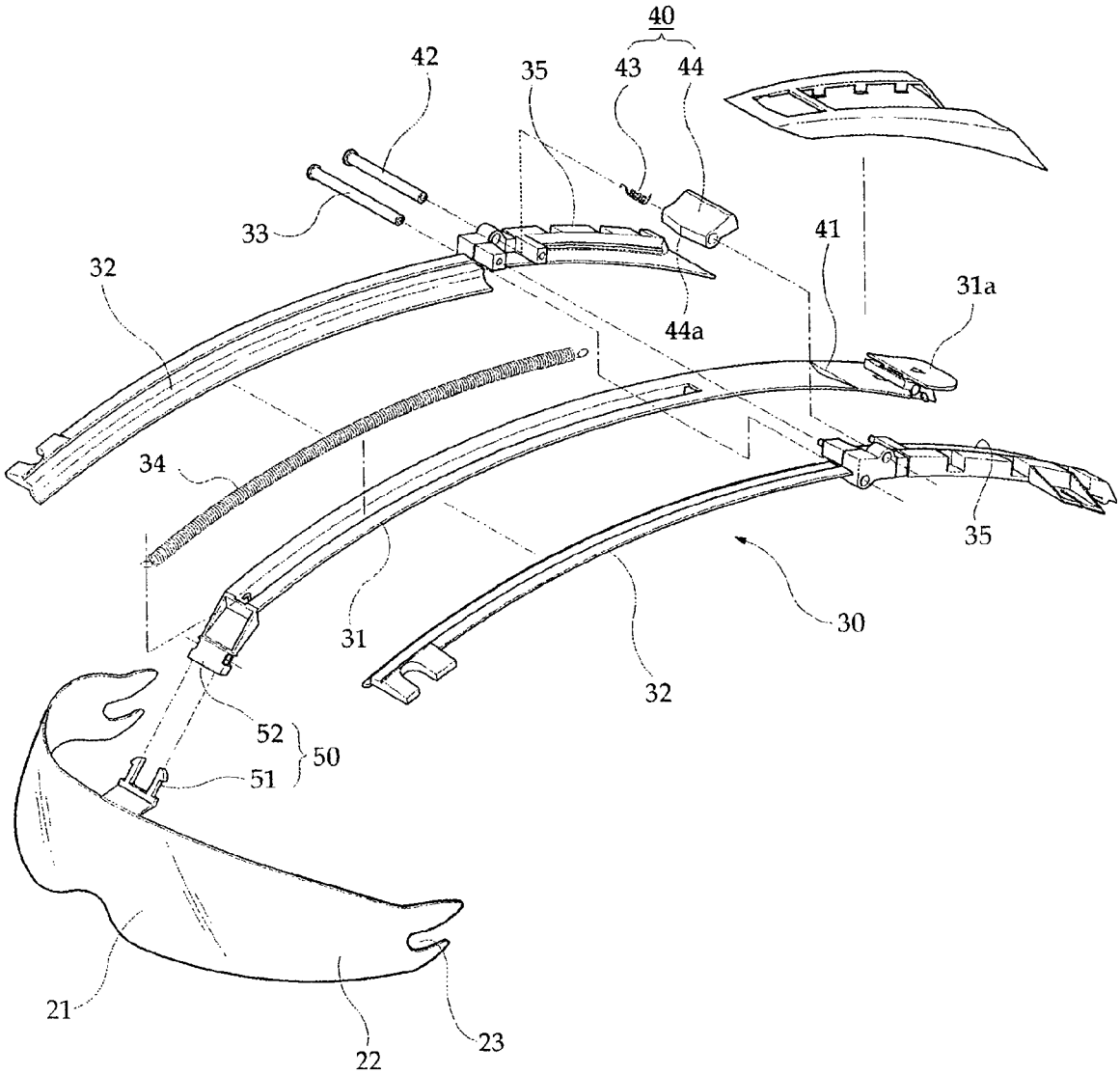

【Fig. 3】
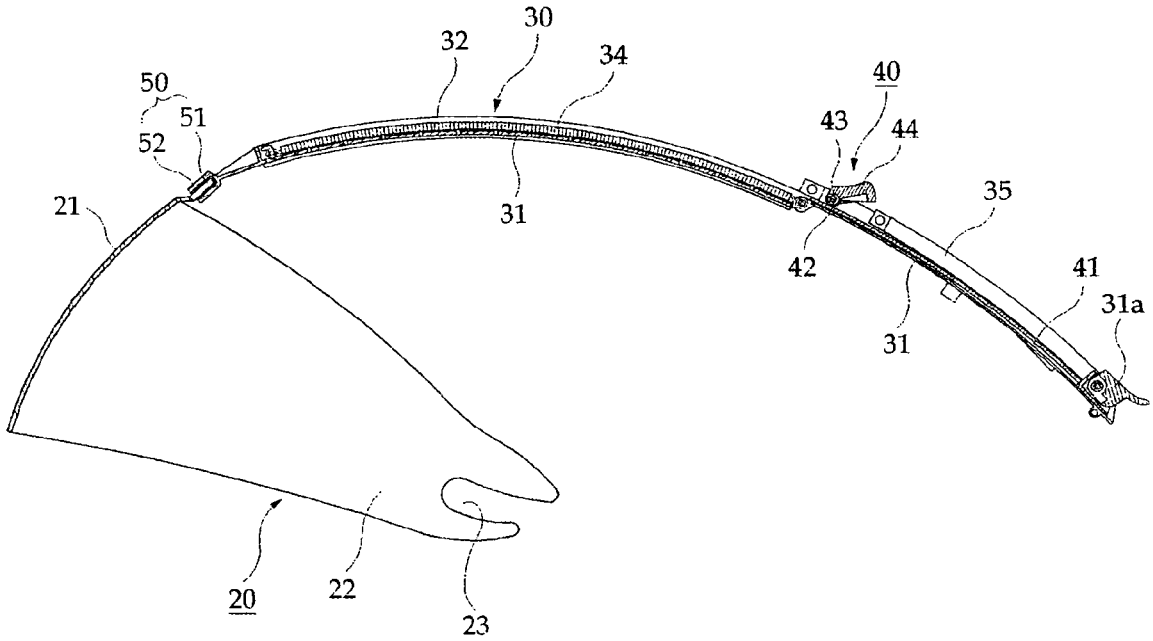

【Fig. 4】
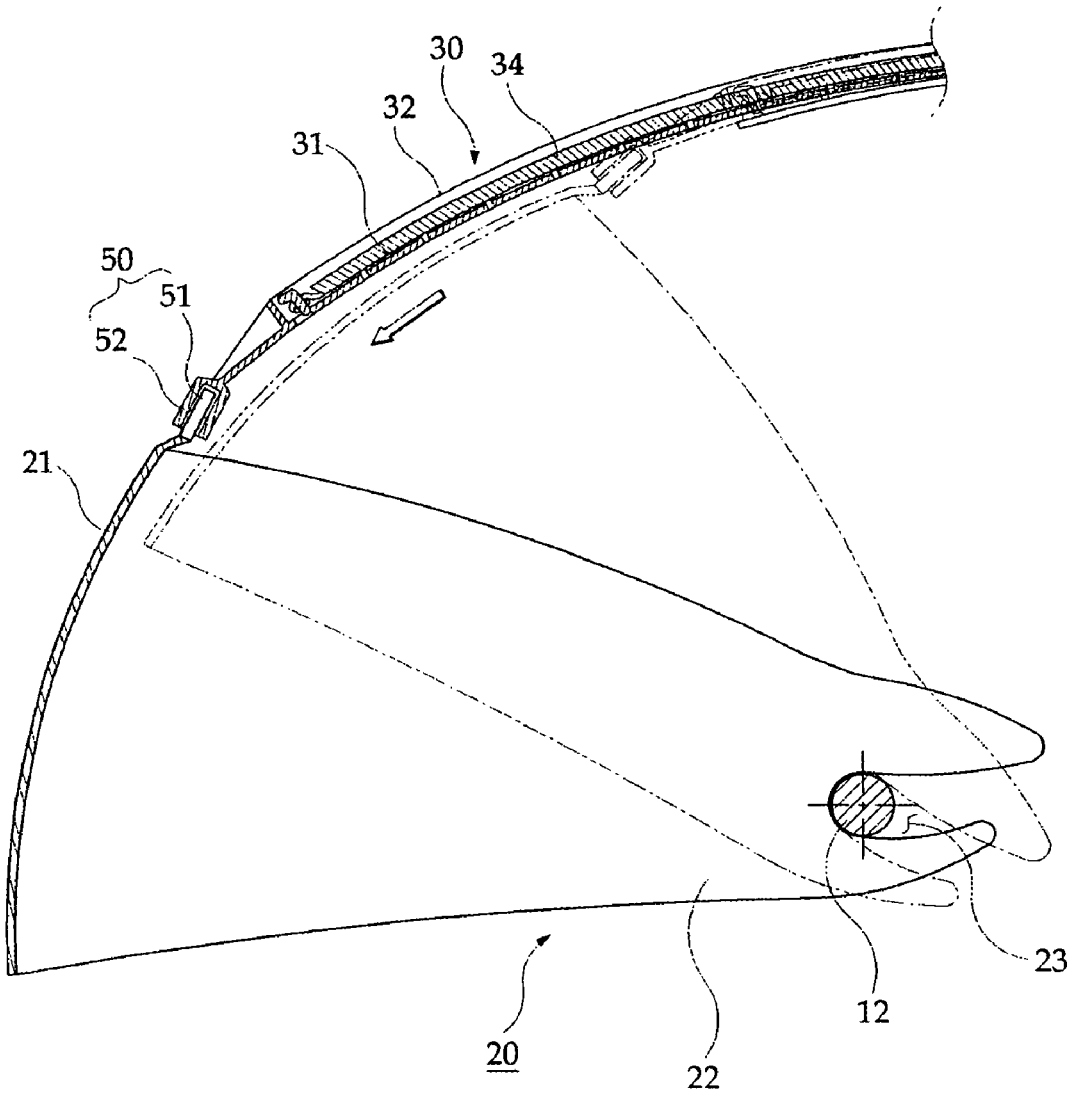

【Fig. 5】
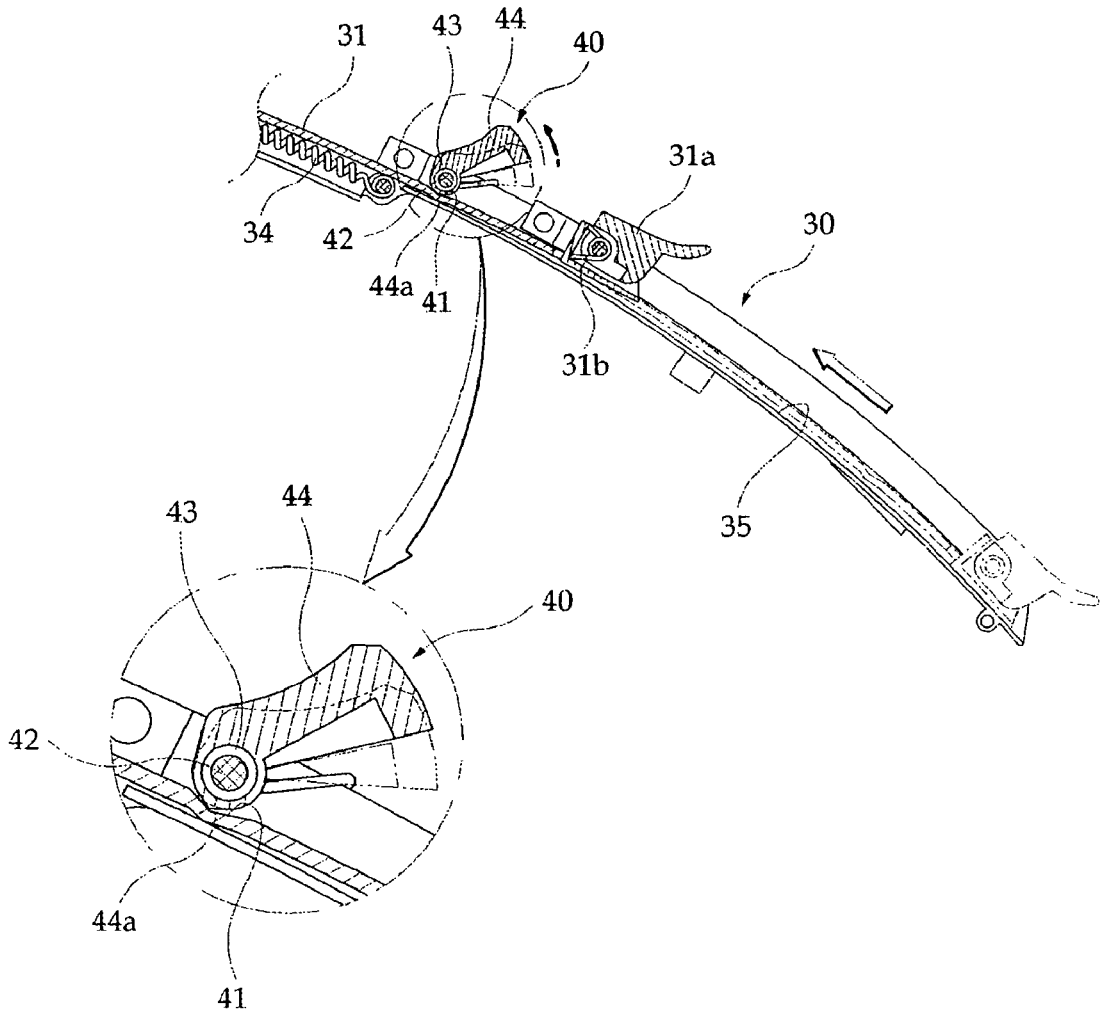

DEVICE FOR OPENING-CLOSING SUN VISOR OF HELMET

BACKGROUND OF THE INVENTION

1. Field of the Invention

The present invention relates to a device for opening-closing sun visor of a helmet, and more specifically to a device for opening-closing sun visor of a helmet wherein the opening-closing of the sun visor can be operated in the upper central portion of the helmet, and one-touch operation enables return to the original position so as to be helpful to safety operation, and the sun visor can be replaced easily according to the option of the user.

2. Description of the Related Art

When driving motorcycles, a safety helmet must be worn to protect the head of the rider, and a shield is installed in front of the helmet for the field of vision not to be obstructed by the wind power generated from front during driving and also to solve breathing difficulty.

And, the inside of the shield is provided with an opening-closing sun visor to prevent sunlight from coming directly into the eye.

In the conventional opening-closing structure of such an opening-closing sun visor, hinge shafts are provided on the left and right sides of the helmet body, and both ends of the extending portion of the sun visor are pivotably connected, and an operation lever or an operation knob is connected to any one side of the extending portion for opening-closing action.

But because the conventional sun visor as described above is provided with the operation lever or the operation knob on any one side of the left or right extending portion while the other side is configured to be operated passively, the action of the side being moved is unstable due to unbalance of forces during the opening-closing operation, and if it is used for a long period in such a condition, malfunction is frequent and the lifetime is shortened.

Moreover, as described above, because a sun visor assembled and produced as one unit at the time of helmet production is assembled in one body with the helmet, the drawback is that it is not replaceable by the user.

SUMMARY OF THE INVENTION

Therefore, it is an object of the present invention to provide a device for opening-closing sun visor of a helmet wherein operation is possible with left-right balance maintained at all times by making the sun visor operable from top of the helmet and by making the sun visor in use return to the original position with a just simple one-touch operation for safe operation of the wearer, and the sun visor is improved such that it can be disassembled and assembled easily from the helmet so as to enable selection and use of the sun visor to wearer's liking.

In accordance with the present invention, there is provided a device for opening-closing sun visor of a helmet comprising: a helmet body provided in front with an opening portion for the face and having a pair of hinge shafts protruded on both the left and right sides; a sun visor having a visor portion placed on the side of the opening portion of the helmet body, extending portions extended to the left and right sides of the visor portion, and hinge slots formed at the ends of the extending portions; and an opening-closing mechanism having a slider the one end of which is connected to the top center of the visor portion of the sun visor and the other end of which is provided with a knob, a guide rail which is attached to the ceiling of the helmet body for guiding the forward and backward movements of the slider, and a guide holder which is attached lengthwise to the top center of the helmet body for guiding the sliding of the slider.

Preferably, the opening-closing mechanism further comprises a locking means for maintaining the position moved forward with the slider moved forward, and the locking means includes a locking slot formed on the surface of the slider and a locking stopper or latch which is pivotably mounted to a guide holder by a hinge pin and elastically supported by a spring.

Preferably, the slider of the opening-closing mechanism is provided with a return spring for quickly returning to the original position from the advanced position, and the one end of the return spring is connected to a protuberance formed on the front end of the slider and the other end is connected to a pin which is inserted into one end of the guide holder.

Preferably, the opening-closing mechanism further comprises an attaching-detaching means which detachably installs the sun visor on the slider, and the attaching-detaching means includes a hook formed in the center of the visor portion of the sun visor and a hook holder formed on the front end of the slider into which the hook is inserted.

BRIEF DESCRIPTION OF THE DRAWINGS

Other objects and aspects of the present invention will become apparent from the following description of embodiments with reference to the accompanying drawings in which:

FIG. 1 is a perspective view of a helmet showing how a sun visor opening-closing device according to the present invention is being used;

FIG. 2 is an exploded perspective view showing the configuration of the main part of the sun visor opening-closing device according to the present invention;

FIG. 3 is a sectional view showing the main part of the sun visor opening-closing device according to the present invention;

FIG. 4 is an enlarged sectional view showing the operation of the sun visor opening-closing device according to the present invention;

FIG. 5 is an enlarged sectional view showing the operation of a locking means according to the present invention.

DESCRIPTION OF THE PREFERRED EMBODIMENT

Below will be described in detail a device for opening-closing sun visor of a helmet according to the present invention with reference to the accompanying drawings.

FIG. 1 is a perspective view of a helmet showing how a sun visor opening-closing device according to the present invention is being used, FIG. 2 is an exploded perspective view showing the configuration of the main part of the sun visor opening-closing device according to the present invention, FIG. 3 is a sectional view showing the main part of the sun visor opening-closing device according to the present invention.

As shown in FIG. 1, the device for opening-closing sun visor of a helmet according to the present invention is installed in the upper part of a helmet body 10 and comprises a sun visor 20 and a sun visor opening-closing mechanism 30. The helmet body 10 has ventilating holes 13 at the top portion thereof.

The left and right sides of the helmet body 10 having an opening portion 11 for the face in front are provided with a pair of hinge shafts 12 necessary for opening and closing the sun visor 20.

And the sun visor 20, as shown in FIG. 2, comprises a visor portion 21 for shielding the opening of the helmet body 10 and extending portions 22 extended to the left and right sides of the visor portion 21, and hinge slots 23 of long hole are formed lengthwise at the ends of both extending portions 22.

As shown in FIG. 2, the sun visor opening-closing mechanism 30 comprises a slider 31 the front end of which is connected to the top center of the visor portion 21 of the sun visor 20 and the rear end of which has a knob 31*a*; a guide rail 32 attached to the ceiling of the helmet body 10 for guiding the forward and backward movement of the slider 31; and a guide holder 35 attached to the top center of the helmet body 10 lengthwise for guiding the sliding of the slider 31.

In the present detailed description, the front end or forward refers to the direction of motorcycle going ahead, and the rear end or backward refers to the opposite direction.

And, the slider 31 of the opening-closing mechanism 30 is provided with a return spring 34 for returning the slider 31 quickly to the original position from the forward position. The front end of the return spring 34 is connected to a protuberance formed at the front end of the slider 31, and the other end is connected to a pin 33 which is inserted into one end of the guide holder 35.

As shown in FIG. 5, a spring 31*b* is inserted into the knob 31*a* to provide restoration force by elastic force. Accordingly, if the user pushes the knob 31*a* upward, it is pivoted upward to have locking condition released, and if he lets it go, the knob 31*a* is pivoted downward by the spring 31*b* to return to the original position.

And, the opening-closing mechanism 30 is provided with a locking means 40 for maintaining the position of the slider 31 in the advanced condition. This locking means 40 comprises a locking slot 41 formed on the surface of the slider 31 and a locking stopper or latch 44 fitted pivotably to a guide holder 35 by a hinge pin 42 and elastically supported by a spring 43. As shown in FIG. 5, the end 44*a* of the locking stopper or latch 44 is caught in the locking slot 41.

And, the opening-closing mechanism 30 has an attaching-detaching means 50 for detachably mounting the sun visor 20 on the slider 31. The attaching-detaching means 50 comprises a hook 51 formed in the center of the visor portion 21 of the sun visor and a hook holder 52 formed at the front end of the slider 31 into which the hook 51 is inserted.

The operation of the device for opening-closing a sun visor configured like this will be described.

FIG. 4 is an enlarged sectional view showing the operation of the sun visor opening-closing device according to the present invention, and FIG. 5 is an enlarged section view showing the operation of the locking means of the present invention.

When the helmet wearer wants to use the sun visor, he raises his hand above the helmet to hold the knob 31*a* of the slider 31 and move it forward. (See FIG. 5)

At this time, because the spring 31*b* is inserted into the knob 3l*a*, when the slider 31 moves forward it moves forward while it is being lifted up, and if the wearer lets go his hand when the slider 31 has moved forward completely and the bottom end 44*a* of the locking stopper or latch 44 is caught in the locking slot 41, the knob 31*a* is brought down by the force of the spring 31*b*.

Since the top center of the sun visor 20 is connected to the front end of the advancing slider 31, as shown in FIG. 3, it pivots around the hinge shafts 12 provided on the left and right sides of the helmet body 10 to be positioned in the opened portion 11, namely, in front of the eye of the wearer.

Namely, as shown in FIG. 4, the extending portions 22 of both sides of the sun visor 20 pivot on the hinge shaft 12 of the helmet body 10 as fulcrum to make the visor portion 21 come down.

Meanwhile, the locking means 40 acts in order to maintain the condition of pivoting of the visor portion 21 like this.

When the locking slot 41 provided on the top surface is positioned down, the completely advanced slider 31 is caught by the end 44*a* of the locking stopper or latch 44 pivoting downward so as to maintain such a condition.

The locking stopper or latch 44 is pivoted by the hinge pin 42 and pressed by the spring 43 to act so as to pivot always in one direction (in the direction of the locking slot 41 on the surface of the slider 31), so when the locking slot 41 arrives below it, it is automatically inserted into the locking slot 41 to maintain locking condition.

In this condition, when the wearer does not feel the necessity of wearing the sun visor, he just presses the locking stopper or latch 44 of the locking means 40. Accordingly, the locking stopper or latch 44 is released from the locking slot 41 to unlock, and the slider 31 is pulled backward by the return spring 34. Due to this, the visor portion 21 of the sun visor 20 is moved upward into the helmet body 10.

Namely, when the locking stopper or latch 44 is pressed artificially, the end 44*a* is released from the catch of the locking slot 41 of the slider 31, so the slider 31 is immediately moved backward along the guide rail 32 by the return spring 34 and returns to the original position.

The important point in such a process of operation is that it is operated by pushing and pulling the visor portion 21 in the center of the sun visor 20, so it is operated in a condition in which the balance of left and right forces are well maintained.

And, it is very helpful for safe operation that the visor portion 21 of the sun visor 20 is removed from the field of vision just by pressing (one touch) operation of the locking stopper or latch 44 like this.

For example, suppose the wearer goes into a tunnel driving on the road in daytime, and he can turn up the sun visor by a very quick and simple operation of lightly pressing the locking stopper or latch 44, so the time of letting go the handle during driving is extremely shortened.

Meanwhile, the sun visor 20 of the present invention is replaceable according to wearer's option.

Namely, as shown in FIG. 2, the hook 51 inserted into the hook holder 52 of the slider 31 is a common fastening means, so it can be easily separated by pushing and pulling the end thereof, and also the hinge slot 23 of either extending portion 22 is a U-shaped slot of an open form, so it is easily disassembled by pulling forward in that condition.

And, when assembling a new sun visor 20, it can be easily assembled by proceeding the previous disassembly process in reverse order.

Therefore, the helmet user may purchase one he likes from sun visors manufactured and supplied in various colors or designs and replace it personally.

As described above, since the present invention has made it possible to operate in the upper center of the helmet the pivoting of the sun visor opened and closed inside of the helmet, it has an advantage that it can be operated with left-right balance maintained, and this prolongs the lifetime of the product.

In addition, since it can be returned just by a simple one-touch operation to return the opened sun visor to the original position, it is advantageous to wearer's safe operation, and since it is improved so as to separate and assemble the sun visor easily, the sun visor can be selected and used to wearer's liking.

Although the present invention has been described in detail reference to its presently preferred embodiment, it will be understood by those skilled in the art that various modifications and equivalents can be made without departing from the spirit and scope of the present invention, as set forth in the appended claims.

What is claimed is:

1. A device for opening-closing sun visor of a helmet comprising;

a helmet body provided in front with an opening portion for the face and having a pair of hinge shafts protruding from the helmet body on left and light sides thereof;

a sun visor having a visor portion alignable with the opening portion of said helmet body, extending portions extended to the left and right sides of the visor portion and hinge slots formed at the ends of the extending portions; and an opening-closing mechanism connected to a top center of the visor portion of said sun visor for enabling or facilitating forward and backward movements thereof;

wherein the opening-closing mechanism comprises:

a slider having a front end connected to the top center of the visor portion of said sun visor and a rear end provided with a knob;

a guide rail which is attached to the ceiling or upper side of the helmet body for guiding forward and backward movements of the slider;

a guide holder which is attached lengthwise to the top center of the helmet body for guiding the sliding of the slider;

a lock for releasably maintaining the slider in a forward or advanced position; and an attaching-detaching means which detachably installs said sun visor on said slider, the lock including a locking slot formed on a surface of the slider and a locking stopper or latch pivotably mounted to the guide holder by a hinge pin and elastically supported by a spring, wherein a bottom end of the locking stopper or latch catches in the locking slot;

the slider being provided with a return spring for quickly returning to an original position from the forward or advanced position, one end of the return spring being connected to a protuberance formed on the front end of the slider and another end of the return spring being connected to a pin inserted into one end of the guide holder, said attaching-detaching means including a hook formed in the center of the visor portion of the sun visor and a hook holder formed on the front end of the slider into which the hook is inserted, said attaching-detaching means being assembled pivotably to the sun visor by inserting the pair of hinge shafts of the helmet body into the hinge slots, wherein each of the hinge slots is a U-shaped slot of open form.

* * * * *